United States Patent [19]

Greenberg

[11] Patent Number: 4,499,447

[45] Date of Patent: Feb. 12, 1985

[54] BLADE TERMINAL FUSES WITH INTEGRITY INDICATOR

[75] Inventor: M. Barry Greenberg, N. Miami Beach, Fla.

[73] Assignee: Guim Multi-Tech Corporation, Miami, Fla.

[21] Appl. No.: 505,334

[22] Filed: Jun. 17, 1983

[51] Int. Cl.[3] ..... H01H 85/32

[52] U.S. Cl. ..... 337/266; 337/241

[58] Field of Search ..... 337/266, 265, 242, 241, 337/264, 198

[56] References Cited

U.S. PATENT DOCUMENTS 3,909,767 9/1975 Williamson et al. ..... 337/198

4,308,516 12/1981 Shimada et al. ..... 337/241

FOREIGN PATENT DOCUMENTS 2831139 1/1980 Fed. Rep. of Germany ..... 337/242

*Primary Examiner*—Harold Broome

*Attorney, Agent, or Firm*—Erwin M. Barnett

[57] ABSTRACT

An integrity indicator formed as an illuminable bead is combined with the pair of flat terminal blades of a miniature plug-in fuse and is positioned in a central window provided in the top wall of the insulator housing thereof. The housing defines a chamber having an open bottom and a central section with relatively narrow lateral sections in which upper portions of the blades are secured. A fuse-wire extends across the central section conductively interconnecting the blades. The illuminable bead has a pair of wire leads extending oppositely into the lateral sections of the chamber, each wire lead conductively contacting the upper portion of one of the blades and connecting the bead in parallel circuit with the fuse-wire. Clamping components formed on the interior of the top wall and on the upper portion of each terminal blade secure each wire lead in operative position. Embodiments include the fuse-wire integrally formed with the blades as a unitary structure and formed separately as a three piece structure wherein opposite ends of the fuse-wire are also secured by the clamping components, the latter being either in coplanar relation with the blades or disposed perpendicular to the plane of the blades.

9 Claims, 20 Drawing Figures

BLADE TERMINAL FUSES WITH INTEGRITY INDICATOR

BACKGROUND OF THE INVENTION

1. Field of the invention

This invention relates generally to miniature, blade terminal fuses currently used in motor vehicle electrical systems and described in U.S. Pat. No. 3,909,767 granted to H. L. Williamson et al and more particularly to a light indicating capability for identifying a blown, open circuit condition of such fuses.

2. Description of the prior art

Recent models of motor vehicles have electrical systems equipped with fuse panels which utilize miniature parallel blade terminal fuses, replacing the familiar cartridge type panels and fuses. These blade terminal fuses, a representative construction of which is described in said Williamson et al patent, provide two methods for identifying a blown, open circuit condition without removal of the fuse from the panel, namely, by a test instrument which may be applied to two test points accessible through openings in the top exposed surface of the fuse housing, or by visual inspection of the fuse-wire through the transparent housing. The requirement of a test instrument, per se, is a considerable disadvantage. Other disadvantages include the difficulty in making visual and test instrument inspection due to the often limited accessibility of the panel and fuses and the failure of visual inspection even after removal of the fuse from the panel when the failure of the fuse is due to a substantially invisible hair-line open circuit resulting from a slight circuit overload.

There is, therefore, a present need for providing such miniature, blade terminal fuses with a visible indicator of a blown, open circuit condition of the fuse which will make the blown fuse readily distinguishable from the other operating fuses in a fuse block.

SUMMARY OF THE INVENTION

Among the objects of the invention is to satisfy the hereinbefore described need by providing a miniature, plug-in blade terminal fuse incorporating an illuminable bead positioned in the top wall of the fuse and comprising solid state elements including an LED for providing the illumination. The several embodiments of the invention shall comprise few and simple parts and be inexpensive to manufacture in quantity production using methods of assembly compatible with existing production procedures and which shall be dependable and efficient in operation.

The invention embodies the combination of a readily visible integrity indicator with now conventional miniature, plug-in blade terminal fuse constructions which comprise an insulator housing and a pair of flat terminal blades in parallel coplanar spaced relation connected in a series circuit by a fuse-wire. The insulator housing is formed with a top wall, an interior chamber having relatively narrow lateral sections on opposite sides of a relatively wider central section and an open bottom. Upper portions of the terminal blades are retained, as by snap-in engagement, in the lateral sections of the interior chamber, the lower portions of the blades projecting downwardly from the open bottom providing the exposed fuse terminals for removably engaging the socket of a fuse block.

The invention features a central window provided in the top wall of the housing above the central section of the chamber through which the integrity indicator, formed as an illuminable bead and positioned in the chamber, is visible. The illuminable bead has a pair of wire leads extending oppositely into the lateral sections of the interior chamber, each wire lead conductively contacting the upper portions of one of the terminal blades and connecting the bead in parallel circuit with the fuse-wire. Clamping means for securing each wire lead in operative position includes a component integrally formed on the interior of the top wall of the housing, one component being located on each side of the central window for coacting with a companion component formed on the end of the upper portion of each of the terminal blades. The snap-in engagement between an opening in the upper portion of each terminal blade and indentations provided in the housing which secures the blades in assembly with the housing also serves to retain the clamping engagement of the wire leads between the top wall of the housing and the ends of the upper portions of the blades.

In an embodiment of the invention, in which the fuse-wire is integrally formed with the terminal blades as a unitary coplanar element, the clamping means component on each side of the window is formed as a rib extending from the top wall of the housing into the lateral section of the chamber and into a V-shaped cutout formed in the end of the upper portion of the blade as the companion component of the clamping means. A section of each wire lead of the illuminable bead is thus formed with a loop and clamped in the V-shaped cutout by the downwardly extending rib.

In another embodiment, the fuse-wire is also integrally formed with the terminal blades which are substantially in coplanar relation except for the clamping means companion components which are incorporated in integral tabs extending from the ends of the upper portion of the blades and disposed perpendicular to the plane of the blades. The clamping means component of the top wall is formed as a groove or cradle along which each wire lead of the illuminable bead extends, side portions of the groove being recessed to accommodate the integral tab which is formed with a central U-shaped cutout through which a portion of the wire lead extends for engagement and clamping retention by the tab.

Other modifications contemplate a five-piece assembly in which the fuse-wire and terminal blade unitary element is formed in three separate parts, namely, a pair of separate terminal blades and a fuse-wire. The two clamping means embodiments hereinbefore described for the three-piece constructions may also be used to secure the opposite ends of a separate fuse-wire in conductive engagement with each of the terminal blades. Thus, the wire leads of the illuminable bead and the end portions of a separate fuse-wire both extend through the clamping means. The illuminable bead is positioned in the window of the top wall of the housing as in the other embodiments while the fuse-wire is formed with a looped midportion extending downwardly from the top wall and through the central section of the housing chamber.

DESCRIPTION OF THE PREFERRED EMBODIMENTS

Figure 1:
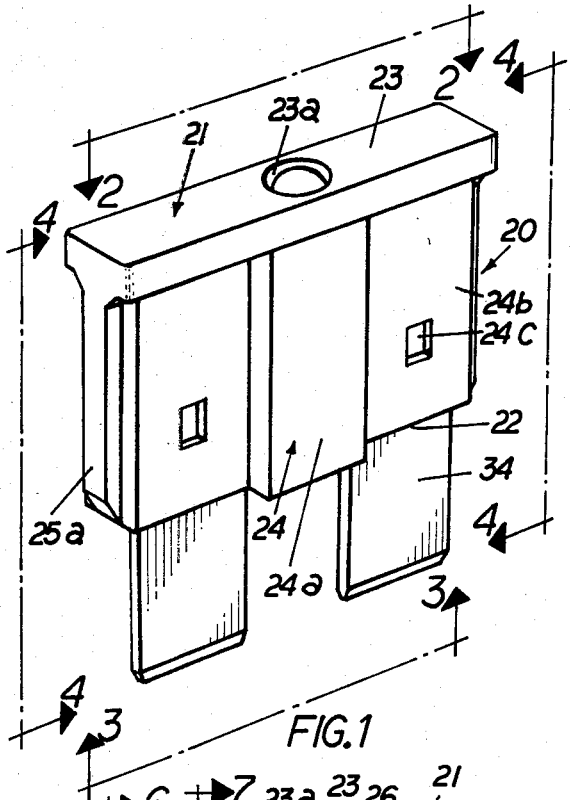
FIG. 1 is a perspective view of a miniature blade terminal fuse constructed with an integrity indicator embodying the invention.
Figure 2:
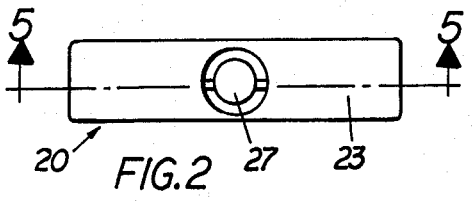
FIG. 2 is a top plan view as seen along line 2—2 in FIG. 1.
Figure 3:
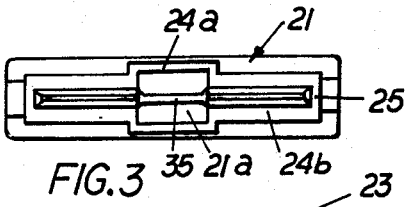
FIG. 3 is a bottom view as seen along line 3—3 in FIG. 1.
Figure 4:
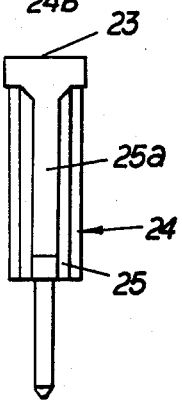
FIG. 4 is a side elevation view as seen along either of the lines 4—4 in FIG. 1.
Figure 5:
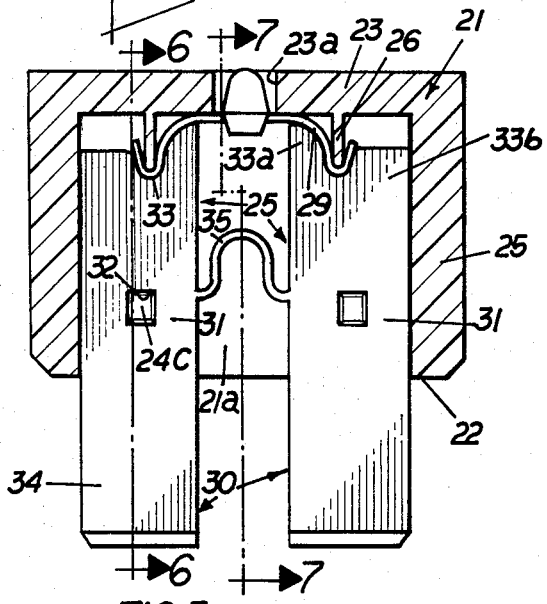
FIG. 5 is a sectional view taken on line 5—5 in FIG. 2 showing interior structure of the fuse.
Figure 6:
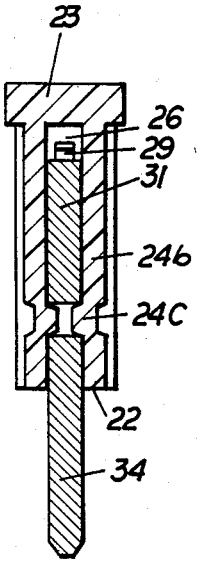
FIGS. 6 and 7 are transverse sectional views taken on lines 6—6 and 7—7, respectively, in FIG. 5.
Figure 7:
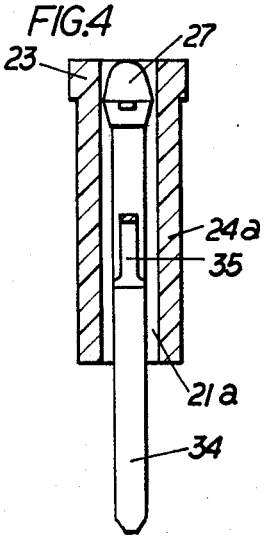

Referring in detail to FIGS. 1 to 7, inclusive, of the drawings, 20 denotes a three-piece miniature, plug-in, blade terminal fuse with an integrity indicator embodying the invention comprising an insulator housing 21, a combined blade terminal and fuse-wire element 30 and an integrity indicator in the form of an illuminable bead 27. As seen in FIGS. 5 and 7, element 30 is formed of sheet metal as a pair of spaced parallel blades 31 integrally interconnected at a midportion thereof by a link fashioned as a fuse-wire 35. Each blade 31 has a centralized opening 32 providing the female component of a snap-in connection between the element 30 and housing 21 and an inner or upper end formed with a generally V-shaped cutout 33 providing for the securing of illuminable bead 27 in position in housing 21 and making electrical contact therewith. Each blade 31 has a lower or outer end portion 34 extending beyond the bottom 22 as a blade terminal or male contact for engaging a cooperating female contact of a fuse socket (not shown).

Housing 21, molded of suitable plastic material having electrical insulating properties, such as, nylon, polystyrene or the like, comprises a relatively long and narrow top wall 23 and a pair of opposite sidewalls 24 connected along opposite lateral margins by end walls 25, all forming an interior chamber which is open along bottom 22. Top wall 23 is formed with a central opening 23*a* providing a window in which illuminable bead 27 is located and end walls 25 each have a vertical rib 25*a* for engagement by means provided in the fuse socket (not shown) for resilient retention therein of fuse 20. Sidewalls 24 are each contoured to provide a pair of lateral panels 24*b* symmetrically arranged on opposite sides of a central panel 24*a*, the latter being outwardly stepped to provide a relatively wide central chamber portion 21*a* therebetween which communicates with top wall opening 23*a*. The opposing lateral panels 24*b* are relatively more closely spaced to accommodate blades 31 therebetween and have aligned indentations 24*c* which engage openings 32 as male components of the snap-in connection between housing 21 and element 30. Each of a pair of interior ribs 26 extends downwardly from top wall 23 between lateral panels 24*b* of the opposite sidewalls 24 into the V-shaped cutout 33 of each blade 31.

Figure 11:
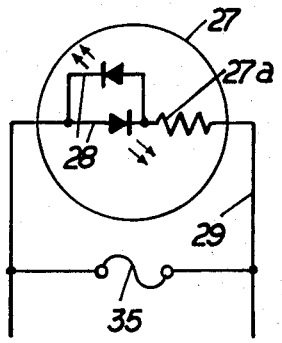
FIG. 11 is a schematic of the electronic components of the integrity indicator shown in parallel circuit with the fuse-wire in accordance with the assembly shown in FIG. 5.

Illuminable bead 27, as seen in FIG. 11, may comprise a pair of LEDs 28 arranged in parallel in opposite polarity and in series with a protecting resistor 27*a* all encased in suitable transluscent material, such as, epoxy, glass or the like, in accordance with conventional solid state technology and has a pair of oppositely extending wire leads 29. Each lead 29 is sized in length and shaped to extend between the medial leg 33*a* of V-shaped cutout 33 and top wall 23, along the curved edge of leg 33*a* and into the bottom of cutout 33 for locking engagement therein by rib 26.

One of the advantages of the construction embodying the invention is the close parallel of the method of assembling the three components of fuse 20 to the production method disclosed in said Williamson et al patent and currently in use. It will be apparent that in practice the assembly is performed in a downwardly vertical direction, namely, with the strip 36 and housing 21 rotated clockwise 90° from the position shown in FIGS. 9 and 10.

Figure 9:
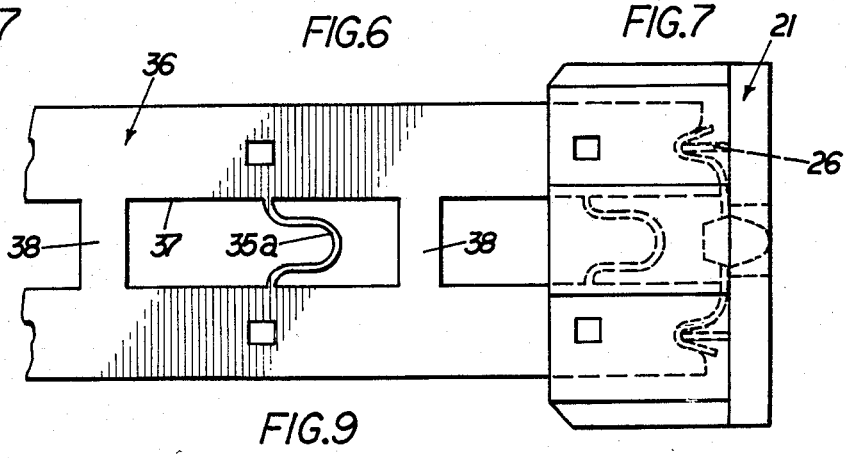
FIGS. 9 and 10 illustrate two steps in the assembly of the molded plastic housing with the other components comprising the fuse shown in FIG. 1.
Figure 10:
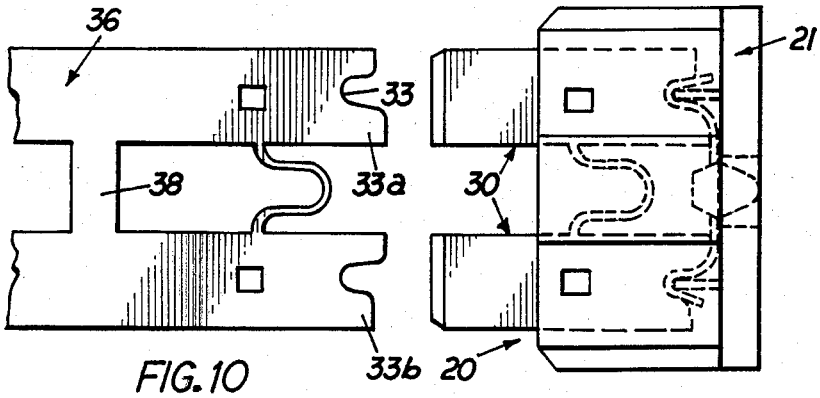

Strip 36, being made of a metal having properties suitable for fuse-wire use, as seen in FIG. 9, is precut with a series of centrally located rectangular openings 37 separated by transverse portions 38 connecting longitudinally extending border portions which when suitably die cut, as hereinafter described, form the spaced parallel blades 31. Likewise, a looped wire structure 35*a* extends through each opening 37 properly aligned with respect to a small opening in each border portion of strip 36 providing fuse-wire 35 and openings 32, respectively, in assembled fuse 20. The leading end of each border portion of strip 36, as seen in FIG. 10, is formed with a V-shaped cutout 33 having a longer medial leg 33*a* and a shorter lateral leg 33*b*.

Figure 8:
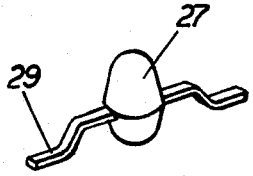
FIG. 8 is a perspective view of the integrity indicator shown prior to assembly with the leads thereof preformed in accordance with the invention.

Assembly may be performed as a continuous process whereby housing 21 is orientated in an inverted position. Illuminable bead 27, having oppositely extending wire leads 29 preshaped as shown in FIG. 8, is also inverted and fed by gravity into the upfacing open bottom of the interior chamber to seat in central opening 23*a* in top wall 23 with wire leads 29 extending between lateral panels 24*b* and across interior ribs 26. The leading end of strip 36 is then inserted into the interior chamber so that wire leads 29 are clamped by V-shaped cutouts 33 against interior ribs 26. In fully inserted position, reached when medial legs 33*a* of blades 31 engage a portion of wire leads 29 adjacent illuminable bead 27 which portions in turn abut the interior surface of top wall 23, indentations 24*c* simultaneously snap into engagement in openings 32 for retention of the three components in operative assembly as fuse 20. Die cutting means (not shown) then severs the leading, assembled, section from strip 36 in the region of the adjacent transverse portion 38, cutting out the latter and forming both the beveled ends of blade portions 34 of the assembled fuse 20 and the V-shaped cutouts 33 as a new leading end of strip 36.

Figure 12:
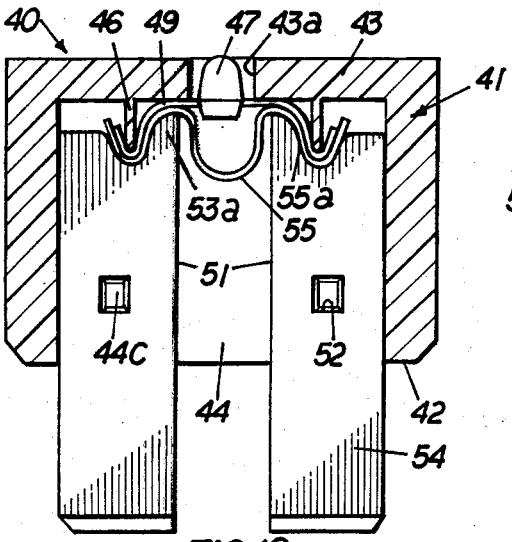
FIG. 12 is a sectional view similar to FIG. 5 but showing a modified assembly construction in which three separate parts comprise the fuse-wire and terminal blade component.
Figure 13:
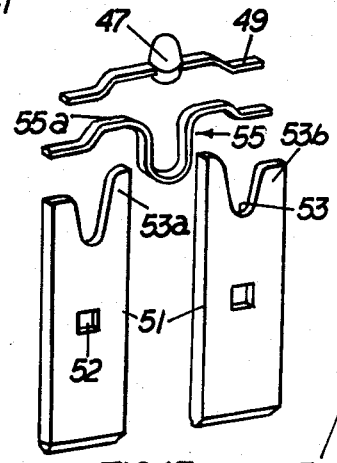
FIG. 13 is an exploded perspective view of the integrity indicator, fuse-wire and pair of blades removed from assembly in the housing shown in FIG. 12.

A modification shown in FIGS. 12 and 13 contemplates a five-piece fuse 40 comprising a housing 41, a pair of spaced parallel blades 51, the upper ends of which clampingly engage both wire leads 49 of illuminable bead 47 and end portions 55*a* of fuse-wire 55. Housing 41 may be substantially identical to housing 21 of fuse 20 and is shown to include a top wall 43 having a central opening 43*a*, opposite sidewalls 44 formed with lateral panels having indentations 44*c* for engaging openings 52 in blades 51, an interior chamber open at bottom 42 and a pair of interior ribs extending downwardly from top wall 43. Each blade 51 has the upper end formed with a V-shaped cutout 53 also provided with longer medial leg 53*a* and a shorter lateral leg 53*b* similar to V-shaped cutout 33 of blades 31.

Figure 17:
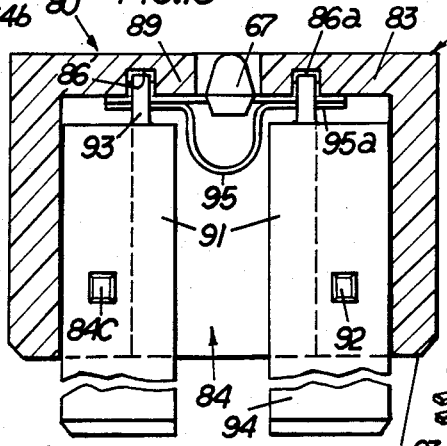
FIG. 17 is a sectional view similar to FIG. 12 showing a five-piece modification of the structure and assembly shown in FIG. 14.
Figure 18:
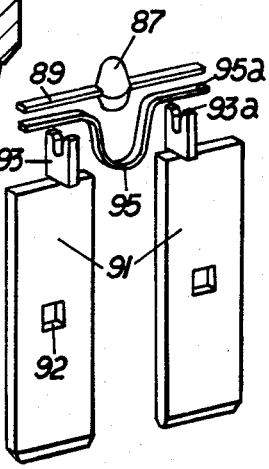
FIG. 18 is an exploded perspective view of the integrity indicator, fuse-wire and pair of blades removed from assembly in the housing shown in FIG. 17.

A modified structure for securing the illuminable bead in position in electrical conductive engagement in series circuit with the terminal blades is shown in FIGS. 14, 15, 16 and 16A for a three-piece fuse and in FIGS. 17 and 18 for a five-piece construction.

Figure 15:
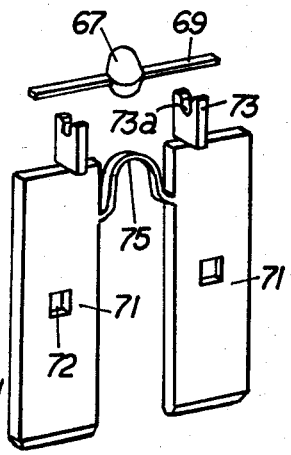
FIG. 15 is an exploded perspective view of the integrity indicator and combined fuse-wire and terminal blade element removed from the assembly in the housing shown in FIG. 14.
Figure 14:
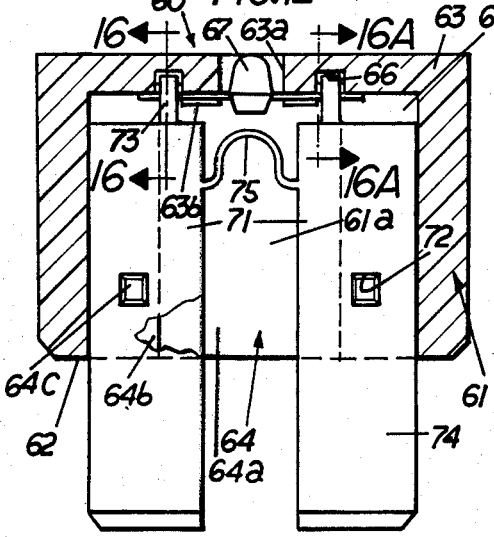
FIG. 14 is a sectional view similar to FIGS. 5 and 12 but showing a modified construction of the three-piece fuse shown in FIG. 5.

Fuse 60, shown in FIGS. 14 and 15, comprises a housing 61, a combined blade terminal and fuse-wire element 70 and an illuminable bead 67 having oppositely extending wire leads 69. Element 70 is similar to element 30 of fuse 20 in the provision of fuse-wire 75 integrally connecting parallel blades 71 having openings 72 for snap-in engagement by indentations 64*c* and an outer end portion 74 extending beyond the bottom 62 of housing 61 but differs from the complete coplanar configuration of element 30 in the formation of an integral tab 73 extending from the inner end of each blade 71 and disposed in a plane perpendicular to that of blades 71 and fuse-wire 75, tabs 73 being formed with U-shaped cutouts 73*a*.

Figure 16A:
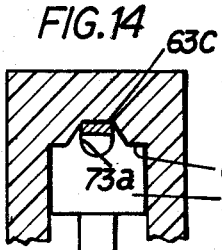
FIGS. 16 and 16A are enlarged sectional views taken on lines 16—16 and 16A—16A, respectively, in FIG. 14 showing structural details.
Figure 16:
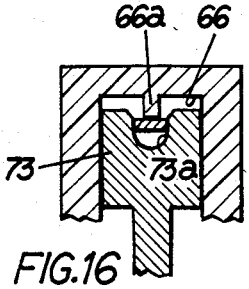

Housing 61, likewise, is a modified form of housing 21, having the interior surface of top wall 63 formed with thickened portions 63*b* extending longitudinally from opposite sides of central opening 63*a*, each portion 63*b* having a medial groove 63*c* which may have inclined walls, as seen in FIG. 16A. A relatively deep depression or recess 66 terminates each groove 63*c* and has as a central longitudinal projection 66*a* seen in FIGS. 14 and 16 as a clamping component for wire lead 69 coacting with a respective integral tab 73 and cutout 73*a*. The lateral panels 64*b* of housing sidewalls 64 are slightly narrower than lateral panels 24*b* of housing 21 providing a central chamber portion 61*a* which is wider than central chamber portion 21*a* for inclusion of tabs 73 therein enabling insertion of element 70 through the open bottom of the chamber during assembly. Grooves 63*c* and the clamping afforded by tabs 73 and recesses 66 enable use of wire leads 69 of bead 67 disposed in a straight line configuration.

Fuse 80, shown in FIGS. 17 and 18, is a five-piece structure similar to fuse 40 in that parallel terminal blades 91 are separate from fuse-wire 95. Otherwise fuse 80 embodies the modifications of fuse 60. Thus, housing 81 is similar to housing 61, having a top wall 83 formed with interior grooves terminating in recesses 86 and projections 86*a*, sidewalls 84 formed to provide an enlarged central chamber portion, an open bottom 82 through which outer end portions 94 of blades 91 project and indentations 84*c* for snap-in engagement with openings 92 of blades 91. The upper ends of blades 91 are also formed with tabs 93 and U-shaped cutouts 93*a* which coact with recesses 86 and projections 86*a* to simultaneously clampingly secure both the wire leads 89 of bead 87 and the end portions 95*a* of fuse-wire 95.

Figure 19:
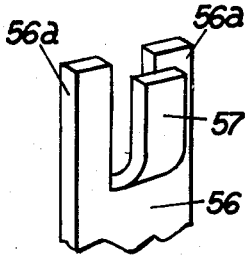
FIG. 19 is a fragmentary perspective view of the upper end of one of the terminal blades showing a modified form of clamping component for the integrity indicator lead wire.

FIG. 19 shows a modified upper end of a blade 56 having a tab 57 cutout and offset from the plane of the blade instead of the perpendicular configuration between tabs 73, 93 and blades 71, 91, respectively, or the coplanar relation of V-shaped cutouts 33 and 53. Wire leads 29, 49, 69 or 89 and fuse wire end portions 55*a* and 95*a* may thus be retained between end portions 56*a* and tab 57 to clampingly engage suitably provided clamping components in top walls 23, 43 63 or 83.

It is to be understood that instead of molding the indentations 24*c*, 44*c*, 64*c* and 84*c* in housings 21, 41, 61 and 81 for snap-in engagement with blade openings 32, 52 72 and 92, respectively, assembly between the respective housings and blades may be accomplished utilizing cold staking or ultrasonic melting means and methods in the well known manner.

Illuminable beads 27, 47, 67 and 87 may be of any desired shape other than that shown in the drawings and the windows provided in top walls 23, 43, 63 and 83 appropriately shaped and may be closed rather than open or formed with a magnifier to intensify the light emitted by the LED. The illuminable beads may also include a single LED requiring orientation means between the fuse housing and the socket receptacle for proper polarity in the D.C. circuits of motor vehicles. Also, in accordance with LED technology, the resistor 27*a* may be an active P-N junction properly polarized with respect to the LED whereby each LED has a P-N junction in series therewith. The LED and P-N junction combinations are in turn in parallel to achieve the universal polarity of the circuit shown in FIG. 11.

In use, any opening of the fuse-wire 35, 55, 75 or 95, as by blowing or otherwise, results in the lighting of the respective illuminable bead while the load remains in the circuit.

The blade terminal fuses with the integrity indicator herein disclosed are seen to achieve the several objects of the invention and to be well adapted to meet conditions of practical use. As various possible embodiments might be made of this invention, and as various changes might be made in the disclosed fuses, it is to be understood that all matters herein set forth or shown in the accompanying drawings are to be interpreted as illustrative and not in a limiting sense.

What is claimed is:

1. A blade terminal fuse having an integrity indicator comprising an insulator housing formed with a top wall, an interior chamber having relatively narrow lateral sections on opposite sides of a central section and an open bottom, a pair of flat terminal blades in coplanar spaced relation having upper portions located in said chamber lateral sections and lower portions projecting downwardly from said open bottom, a fuse-wire extending through said chamber central section conductively connected in series with said terminal blades, said top wall being formed with a central window above said chamber central section and being formed on the interior side thereof on opposite sides of said window with a component of a clamping means, said integrity indicator being an illuminable bead located in said chamber central section in register with said top wall window and having wire leads extending oppositely into said chamber lateral sections conductively contacting said terminal blade upper portions whereby said illuminable bead is in series with said blades and in parallel with said fuse-wire, said terminal blade upper portions each being formed with a companion component of said clamping means, the clamping means securing each of said wire leads in said conductive contact with each terminal blade upper portion.

2. The blade terminal fuse defined in claim 1 in which said pair of flat terminal blades and fuse-wire are formed as an integral structure of a fuse metal.

3. The blade terminal fuse defined in claim 1 in which said pair of flat terminal blades are separate components and said fuse-wire is a discrete element having opposite ends extending into said chamber lateral sections, said clamping means also securing said fuse-wire opposite ends in conductive contact with each terminal blade upper portion as said series connection with the terminal blades.

4. The blade terminal fuse defined in claim 1 in which said housing clamping means components are interior ribs having free ends extending toward said open bottom, said clamping means companion component being a cutout formed in each terminal blade upper portion, said wire leads being retained in said cutouts in said conductive contact by said rib free ends.

5. The blade terminal fuse defined in claim 4 in which said cutouts have medial and lateral legs bordering said cutouts, said medial legs being longer than the lateral legs and serve to clamp portions of said wire leads adjacent the illuminable bead against said top wall.

6. The blade terminal fuse defined in claim 4 in which said cutouts each includes a tab attached to the bottom of the cutout and extending in offset parallel relation to the plane of said blades.

7. The blade terminal fuse defined in claim 1 in which said clamping means companion components each comprise a tab extending perpendicularly to the plane of said blades and formed with cutouts, said top wall clamping means components each including a depression recessed from the interior surface of the top wall in registered alignment to receive one of said tabs therein, each of said illuminable bead lead wires extending along the interior surface of said top wall, across the depression and being engaged in the cutout of one of said tabs as said conductive contact.

8. The blade terminal fuse defined in claim 7 in which said pair of terminal blades, perpendicular tabs and fuse-wire are formed as an integral structure of a fuse metal.

9. The blade terminal fuse defined in claim 7 in which said fuse-wire is a discrete element having opposite ends extending into said chamber lateral sections, said clamping means also securing said fuse-wire opposite ends in conductive contact with each of said tabs as said series connection with the terminal blades.

* * * * *